US007536956B2

(12) United States Patent
Sammons et al.

(10) Patent No.: US 7,536,956 B2
(45) Date of Patent: May 26, 2009

(54) LINEAR SHAPED CHARGE SYSTEM

(75) Inventors: James Sammons, Hendra (AU); Chris Murray, Bronte (AU); Scott Allman, Peakhurst (AU)

(73) Assignee: Rapid Entry Pty Limited, Peakhurst (AU)

( * ) Notice: Subject to any disclaimer, the term of this patent is extended or adjusted under 35 U.S.C. 154(b) by 115 days.

(21) Appl. No.: 10/536,468

(22) PCT Filed: Nov. 28, 2003

(86) PCT No.: PCT/AU03/01585

§ 371 (c)(1),
(2), (4) Date: Mar. 27, 2006

(87) PCT Pub. No.: WO2004/048880

PCT Pub. Date: Jun. 10, 2004

(65) Prior Publication Data

US 2006/0201373 A1 Sep. 14, 2006

(30) Foreign Application Priority Data

Nov. 28, 2002 (AU) ..... 2002952984

(51) Int. Cl.
*F42B 12/00* (2006.01)

(52) U.S. Cl. ..... 102/476; 102/306; 102/307; 102/309; 89/1.14

(58) Field of Classification Search ..... 102/306, 102/307, 476, 309; 89/1.14
See application file for complete search history.

(56) References Cited

U.S. PATENT DOCUMENTS

| | | | | |
|---|---|---|---|---|
| 2,605,704 | A * | 8/1952 | Dumas | 102/307 |
| 3,185,089 | A | 5/1965 | Parkhurst et al. | |
| 3,777,663 | A * | 12/1973 | Brown | 102/331 |
| 4,014,719 | A | 3/1977 | Wells | |
| 4,014,720 | A | 3/1977 | Wells | |
| 4,628,819 | A * | 12/1986 | Backofen et al. | 102/307 |
| 4,693,181 | A * | 9/1987 | Dadley et al. | 102/307 |
| 4,982,665 | A | 1/1991 | Sewell et al. | |
| 5,415,101 | A * | 5/1995 | Brinkmann | 102/307 |
| 6,378,438 | B1 | 4/2002 | Lussier et al. | |
| 6,962,634 | B2 * | 11/2005 | Nielson et al. | 149/19.3 |
| 2003/0131722 | A1 | 7/2003 | Donovan | |

FOREIGN PATENT DOCUMENTS

| | | |
|---|---|---|
| FR | 2 669 723 | 5/1992 |
| GB | 2 148 463 | 5/1985 |
| GB | 2 176 878 | 1/1987 |

OTHER PUBLICATIONS

English Abstract of FR 2 669 723 dated May 29, 1992.

* cited by examiner

*Primary Examiner*—J. W Eldred
*Assistant Examiner*—Gabriel J Klein
(74) *Attorney, Agent, or Firm*—Ladas and Parry LLP

(57) ABSTRACT

An elongate explosive charge element (25), said explosive charge element (25) including a flexible frangible cutting sheet (26) and an explosive agent (27) said charge element (25) adapted to the penetration of a barrier structure.

12 Claims, 12 Drawing Sheets

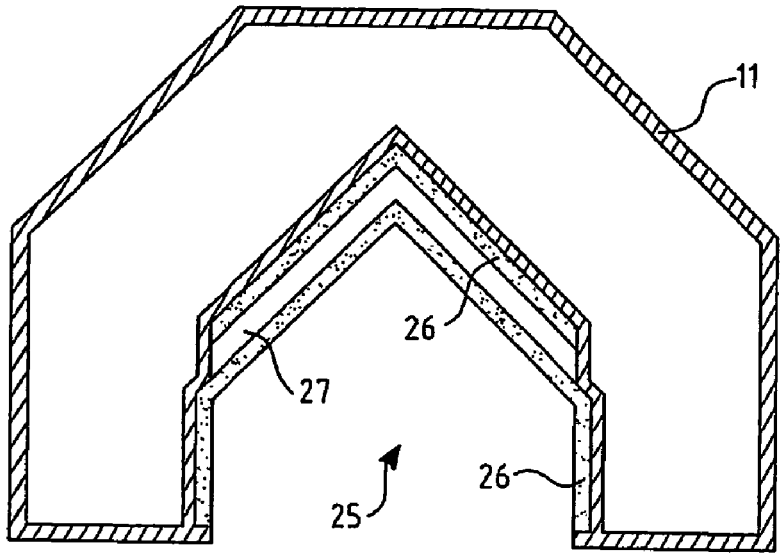
Fig. 6
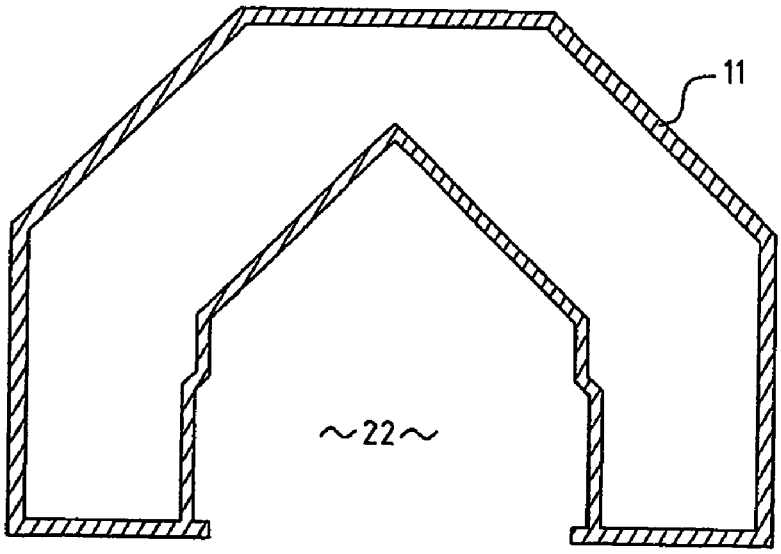
Fig. 5
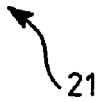

LINEAR SHAPED CHARGE SYSTEM

The present invention relates to systems and methods adapted to shaped charge systems for the controlled application of a destructive explosive charge and, more particularly for the gaining of forced entry into buildings and structures in situations where such entry is required for military or law enforcement purposes and where such entry is denied.

BACKGROUND

In both military and law enforcement operations it may become necessary to gain forced entry into buildings where such entry by normal means is denied. Some examples of such situations may include the rescue of hostages or the interdiction of serious criminal activity. In such situations the more conventional means of forced entry by the use of rams or sledge hammers and the like may be rendered ineffective by the particular structural or barricaded entry conditions of the building.

In such situations the only recourse may be to use explosive entry techniques. These are high risk operations, with known methods making use of metal fragments to effect penetration at the desired point of entry, with risk of injury to the occupants of the building, or even of the operational personnel.

Numerous forms of linear shaped charges may be employed for these purposes as well as for a range of civil applications, particularly in controlled demolition work. Known systems suffer from a number of shortcomings depending on the particular application and the type of charge system. Thus those systems which employ rigid metal liners cannot be applied to curved surfaces and the metal ejecta generated by the liner presents a danger to personnel. Malleable linear charges are known but only allow relatively limited bending.

It is an object of the present invention to offer systems of forced entry using explosive means in which the explosive effect is limited to an extremely short range, or otherwise addresses or ameliorates the above disadvantages.

BRIEF DESCRIPTION OF INVENTION

Accordingly, in one broad form of the invention, there is provided an elongate explosive charge element, said explosive charge element including a flexible frangible cutting sheet, said charge element adapted to the penetration of a barrier structure.

Preferably the charge element of said cutting sheet is comprised of a matrix of polymers including plasticisers, stabilizers and flexible agents, said matrix containing a substantially uniform distribution of powdered material.

Preferably the charge element of said powdered material is selected singly or in combination from a group of metals and ceramics, said group of metals including copper, aluminium, brass and ferrous metals.

Preferably said cutting sheet is formed by an extrusion process.

Preferably the charge element of said cutting sheet is formed by a casting process.

Preferably the charge element of said cutting sheet is associated with an explosive agent.

Preferably said explosive agent is in sheet form laminated to said cutting sheet, the lamination comprising an explosive agent layer and a first cutting sheet layer.

Preferably said lamination of said cutting sheet and said explosive agent layer are formed so as to produce a shaped charge effect when combined with a stand-off material; said charge effect having the general behavioral characteristics of the "Monroe Effect".

Preferably said lamination of said first cutting sheet and said explosive agent layer is combined with a second layer of cutting sheet so as to substantially envelop said explosive agent layer and said first cutting sheet; said second layer acting as a tamping layer.

Accordingly, in a further broad form of the invention, there is provided an elongate explosive charge element, said explosive charge element including a flexible frangible explosive cutting sheet, said charge element adapted to the penetration of a barrier structure.

Preferably said explosive cutting sheet is comprised of a matrix of polymers including plasticisers, stabilizers and flexible agents, said matrix containing a substantially uniform distribution of powdered material, said matrix further containing a distribution of explosive agent.

Preferably said powdered material is selected singly or in combination from a group of metals and ceramics, said group of metals including copper, aluminium, brass and ferrous metals.

Preferably said explosive cutting sheet is formed by an extrusion process.

Preferably said explosive cutting sheet is formed by a casting process.

Preferably said explosive cutting sheet is formed so as to produce a shaped charge effect when combined with a stand-off material; said charge effect having the general behavioral characteristics of the "Monroe Effect".

Preferably said explosive cutting sheet and said stand-off material is combined with a layer of flexible frangible cutting sheet, said flexible frangible cutting sheet acting as a tamping layer.

Preferably said charge element is provided with a metal liner.

Preferably said metal liner is combined with laminations of said flexible frangible cutting sheet and said explosive agent; said metal liner acting a penetrating agent; said cutting sheet acting as a tamping agent.

Preferably said laminations of said cutting sheet, said explosive agent and said liner, when combined with a stand-off material act as a shaped charge with the behavioral characteristics of the "Monroe Effect".

Preferably said metal liner is combined with laminations of said flexible frangible explosive cutting sheet; said metal liner acting as a penetrating agent; said explosive cutting sheet acting as a tamping agent.

Accordingly, in a further broad form of the invention, there is provided a charge carrier adapted to support elongate explosive charge elements, said charge carrier adapted to the penetration of a masonry wall.

Preferably said carrier is comprised of a frame having a generally rectangular perimeter and at least one cross member, the members of said frame and cross member formed of hollow section polymeric material.

Preferably said frame members have an outer face provided with a channel extending the length of said members; said channel adapted to accept said elongate explosive charge element as an insert.

Preferably said frame perimeter and said cross member form a sealed container adapted for the retention of a tamping fluid; said sealed container provided with apertures and closure means for the filling of said tamping fluid.

Preferably the internal surfaces of said sealed container are pre-coated with a gelling agent adapted to modify said tamping fluid into a tamping gel when said fluid is added to said container.

Preferably said frame is provided with foot elements adapted to provide a height adjustment facility to said perimeter frame.

Preferably said frame is provided with an adjustable hinged support brace, said brace attaching to the rear face of a cross member.

Preferably said frame is provided with a plurality of charge ports on the rear face of said frame members.

Preferably said elongate explosive charge element is a composite layered and shaped assembly of flexible frangible cutting sheet and an explosive agent.

Preferably said elongate explosive charge element is a composite layered and shaped assembly of flexible frangible explosive cutting sheet and an explosive agent.

Preferably said explosive charge element includes a shaped metal liner.

Accordingly, in a further broad form of the invention, there is provided a charge carrier adapted to support an elongate explosive charge element adapted to effect a directed explosive charge for the penetration of a barrier in which the penetrating agent is a fluid.

Preferably said barrier is comprised of structures including domestic and commercial metal roller doors, metal doors, fire doors, reinforced timber doors and glass doors.

Preferably said carrier is comprised of an elongate body of hollow section polymeric material.

Preferably said elongate body is provided with a sealing end cap at a first end and filler end cap at a second end.

Preferably said filler end cap is provided with an aperture and closure means adapted to allow the filling of said body with a tamping fluid.

Preferably said filler end cap is provided with a detonating cord grommet.

Preferably the internal walls of said body are pre-coated with a gelling agent adapted to modify said tamping fluid into a tamping gel when said fluid is added to said body.

Preferably said elongate body is provided with an adjustable foot element adapted to provide a height adjustment facility to said body.

Preferably said elongate body is provided with an adjustable hinged brace.

Preferably said body is provided with flexible magnetic strips disposed along portions of the front face of said body, said strips adapted to attach said charge carrier to a ferrous metal surface.

Preferably said elongate body is provided with internal guide rails adapted to accept a loading card as a friction sliding fit.

Preferably said loading card is an elongate polymeric extrusion having front and rear wall elements separated by transverse dividing elements so as to form a number of longitudinal passages through the length of said card.

Preferably said loading card is provided with a series of slots and holes disposed at each end of said card adapted to accept and retain a winding of detonating cord laid along the front face of said card so as to form an explosive charge element.

Preferably said explosive charge element is combined with a flexible frangible cutting sheet.

Preferably said explosive charge element comprises a frangible cutting sheet, the matrix of said cutting sheet containing a distributed explosive agent.

Accordingly, in a further broad form of the invention, there is provided a method for the penetration of a barrier structure, said method including the steps of, a. forming a flexible frangible cutting sheet by a process of extruding or casting in a suitable mould, a mixture of polymers including plasticisers, stabilizers, flexible agents and powdered metal or ceramics,
b. shaping said cutting sheet in combination with a layer of explosive agent and a stand-off material to form an elongate explosive charge element,
c. placing said explosive charge element in contact with said barrier structure and detonating said explosive charge element.

Accordingly, in a further broad form of the invention, there is provide a method for the penetration of a barrier structure, said method including the steps of.

a. forming a flexible frangible explosive cutting sheet by a process of extruding or casting in a suitable mould, a mixture of polymers including plasticisers, stabilizers and flexible agents, powdered metal or ceramics and an explosive agent,
b. shaping said explosive cutting sheet and combining said sheet with a stand-off material to form an elongate explosive charge element,
c. placing said explosive charge element in contact with said barrier structure and detonating said explosive charge element.

Accordingly, in a further broad form of the invention, there is provided a method for the penetration of a barrier structure using a charge carrier, said method including the steps of, a. installing an elongate explosive charge element in said charge carrier,
b. filling said charge carrier with a tamping agent,
c. placing said charge carrier in contact with said barrier structure and detonating said explosive charge element.

Accordingly, in a further broad form of the invention, there is provided a flexible linear charge system comprising elongate elements; said elements including a malleable explosive charge element, a liner and a stand-off member enveloped in a flexible elongate inertial mass carapace.

Preferably said malleable explosive charge element is comprised of flexible sheet explosive shaped so as to produce jetting of said liner when detonated.

Preferably said jetting produces a "Monroe Effect".

Preferably said liner is a composite of an extruded matrix containing a dense distribution of solid particulate matter.

Preferably said solid particulate matter is a dense metal carbide.

Preferably said solid particulate matter is any plasticized metal.

Preferably said stand-off member is comprised of closed-cell plastic foam.

Preferably said stand-off member is comprised of an extruded polymeric tube.

Preferably said inertial mass carapace is comprised of an extruded compound of a metallic powder and plasticizer.

Preferably said inertial mass carapace is adapted to substantially envelop said elongate elements leaving at least an exposed portion along that side of said stand-off member opposite said explosive charge element.

Preferably said inertial mass carapace is formed with flat surfaces adjoining each side of said at least an exposed portion; said flat surfaces provided with attachment means for attachment to a surface to which said linear charge system is to be applied.

Preferably said attachment means are self-adhesive strips.

Preferably said attachment means are magnetic strips attached to said flat surfaces.

Preferably bungs are adapted to close off open ends of said extruded polymeric tube so as to allow retention of a fluid therein.

Preferably at least one of said bungs is provided with one-way valve means adapted to the passage of said fluid into said extruded polymeric tube.

Preferably said fluid is a pressurized gas.

Accordingly, in a further broad form of the invention, there is provided a flexible linear charge element comprising an extruded closed cell carcass provided with a central aperture; said carcass having an upper arcuate surface and a lower flat surface and laterally extending flange portions; said arcuate surface overlaid by a first layer composed of a frangible liner material.

Preferably said first layer is overlaid by a second layer comprising an explosive sheet.

Preferably said first layer is overlaid by a second layer comprising an inertial mass carapace.

Preferably said flat surface is provided with an adhesive layer.

Accordingly, in a further broad form of the invention, there is provided a linear charge carrier element comprising a length of a section of plastic tube having an outer surface to which is affixed an inner surface of a first layer comprising explosive sheet material and wherein a second layer of suitable fibrous material is affixed to an outer surface of said explosive sheet material so as to form a backing.

Preferably said fibrous material is cardboard.

The flexible linear charge system as herein described and with reference to the accompanying drawings.

BRIEF DESCRIPTION OF THE DRAWINGS

Embodiments of the present invention will now be described with reference to the accompanying drawings wherein:

FIG. 5 is a cross sectional view of a member of the charge carrier of FIG. 3.

FIG. 6 is a cross sectional view of the member of FIG. 5 with an elongate shaped explosive charge element installed.

DETAILED DESCRIPTION OF PREFERRED EMBODIMENTS

Figure 1:
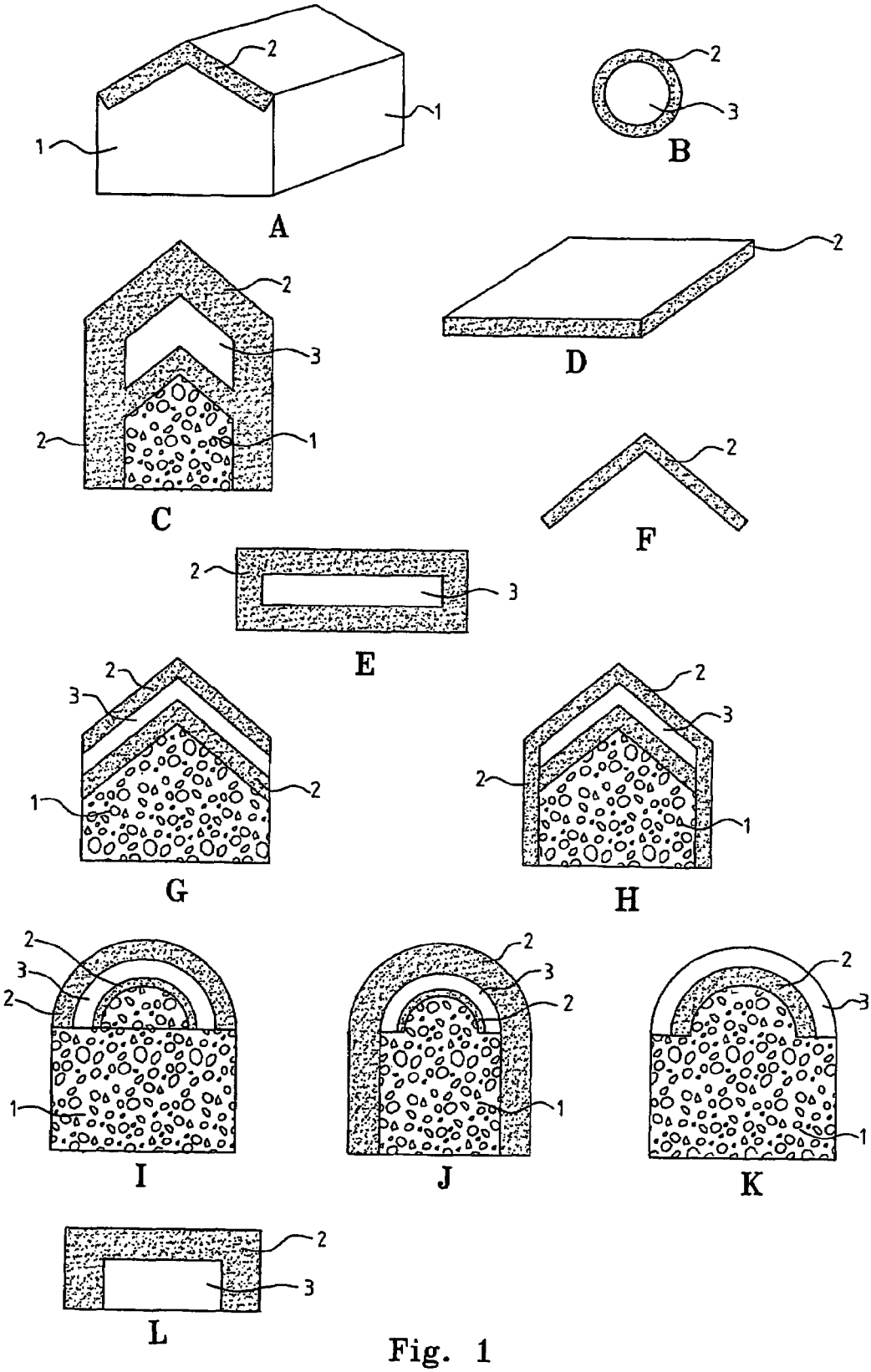
FIGS. 1A to 1L are cross sectional views of a variety of elongate shaped explosive charge elements according to a first embodiment of the invention.

In accordance with a first embodiment of a forced entry system, a principle component in this instance of which is a flexible frangible cutting sheet intended for use with explosive charges to cut through obstructing material. The structure of this sheet is made up of a polymer matrix including plasticisers, stabilizers and flexible agents, containing a substantially uniform distribution of powdered metal. The metal may be any one of a selection of metals including for example, copper, aluminium, brass, ferrous metals, ceramics or a combination of these.

Preferably the particulate size of the metal or ceramic powder is in the order of 1 to 10 microns but both smaller and larger particles may be used. Different combinations of sheet thickness, particle density and particle size may be formulated depending on the explosive charge to be used and the nature of the barrier structure to be penetrated. That structure may comprise a wide range of materials including wood, metal, masonry, glass, polycarbonates and other plastics as well as composites.

The flexible nature of the cutting sheet enables it to be combined into a variety of elongate shaped charges when provided with an explosive agent. Desired shapes may also be achieved by extrusion, casting or fabricating.

By suitable shaping and the use of a stand-off material the cutting sheet may be adapted to take advantage of the "Monroe Effect" wherein the detonation of the explosive agent creates a high energy linear jet of gas. The stand-off material serves to provide that distance between the explosive agent and the target required for the accelerating gas and particles of the cutting sheet to reach an effective penetration velocity. The stand-off material may be made of any light frangible material such as for example a polystyrene foam.

FIGS. 1A to 1L show a number of examples of preferred configurations of a cutting sheet (2), stand-off material (1) and explosive agent (3). As shown for example in FIGS. 1A, 1C, 1G, 1H, 1I and 1J, an additional layer of flexible frangible cutting sheet (2) may be incorporated as a tamping layer.

It is a feature of the flexible frangible cutting sheet that the individual particles accelerated by the blast are of very low mass and thus lose energy rapidly from their initial high energy state after detonation of the explosive agent. As a result their penetration effect is limited to a very short range, thus minimizing fragmentation and the likelihood of unintended injury to any persons within the structure to be penetrated.

In an extruded form, the flexible frangible cutting sheet may be backed with a sheet explosive agent to obtain the desired cutting effect. Furthermore, extruded forms may be placed in a carrier adapted to incorporate a fluid tamping means, as is further set out below.

In a second preferred embodiment of the invention, the flexible frangible cutting sheet is itself loaded with an explosive charge to produce a flexible frangible explosive cutting sheet. As with the first embodiment this sheet may be formed by a variety of means including extrusion, casting and fabrication, and may be shaped and combined with a suitable stand-off material to produce a "Munroe Effect" discharge when detonated.

Figure 2:
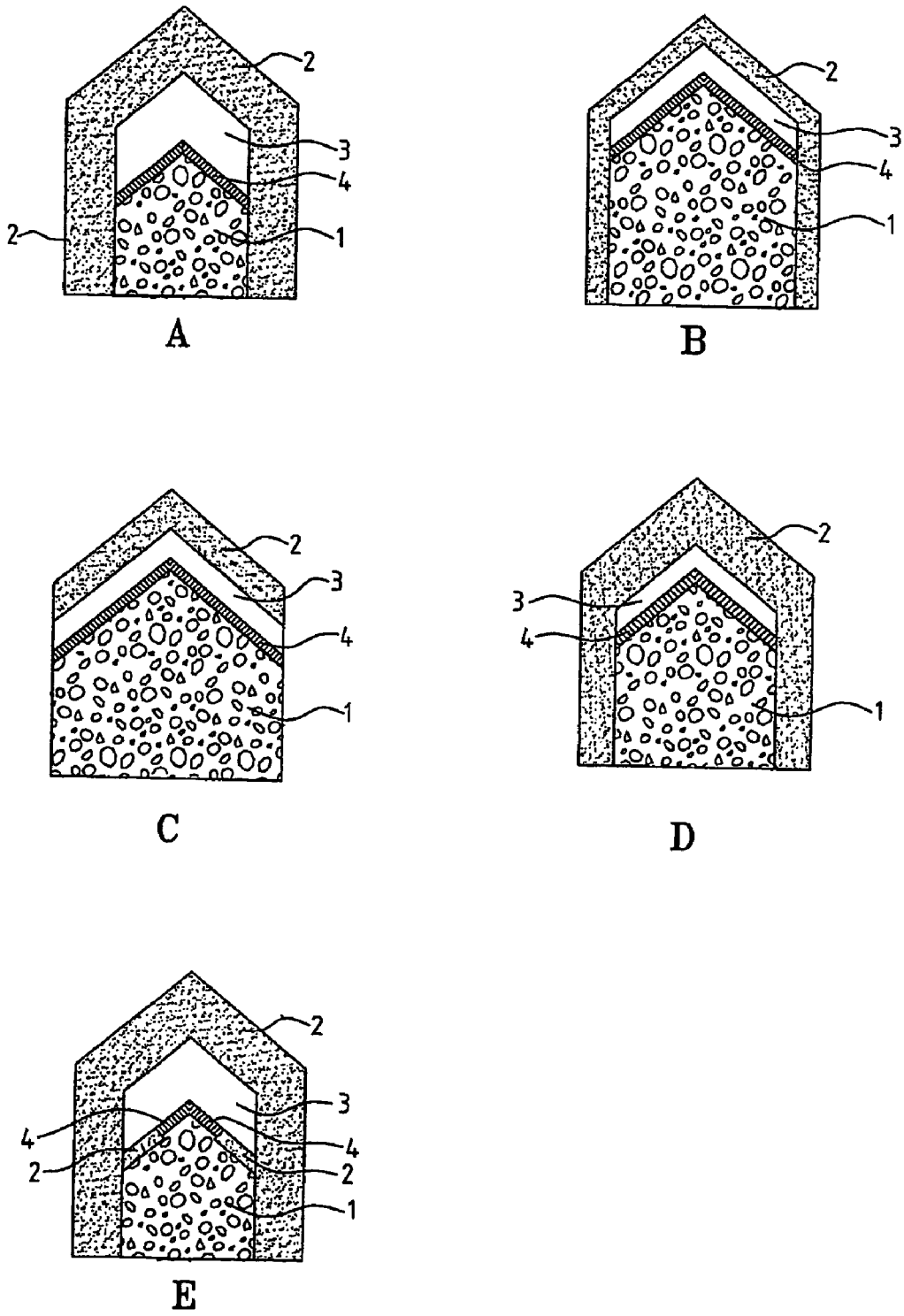
FIGS. 2A to 2E are cross sectional views of a variety of elongate shaped explosive charge elements according to a second embodiment of the invention.

In a third preferred embodiment of the invention, either the flexible frangible cutting sheet or the flexible frangible explosive cutting sheet, may be combined in a variety of configurations with explosive agents and a metal liner, as shown in FIG. 2 in which (2) is a layer of flexible frangible cutting sheet or flexible frangible explosive cutting sheet, (3) is an explosive agent, (1) is a stand-off material and (4) is the metal liner.

In this embodiment it is the metal liner which acts as the cutting or penetrating agent with the cutting sheet providing a tamping effect and aiding the shaping of the "Monroe Effect".

All the embodiments of explosive charges described above may be used alone by direct application to the surface to be penetrated, or as charge elements of charge carriers according to the invention.

Figure 3:
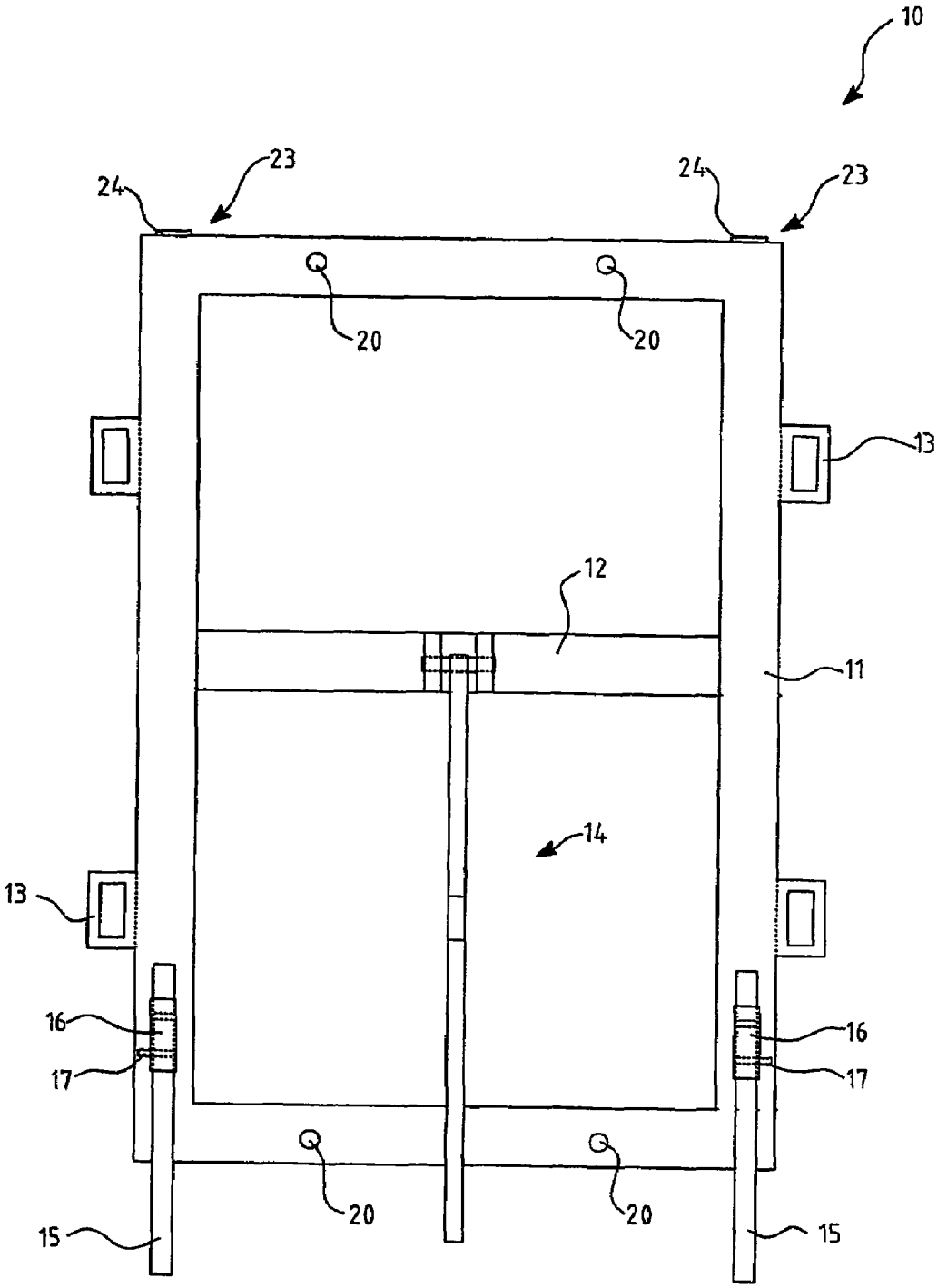
FIG. 3 is a rear elevation view of a first embodiment of a charge carrier according to the invention.
Figure 4:
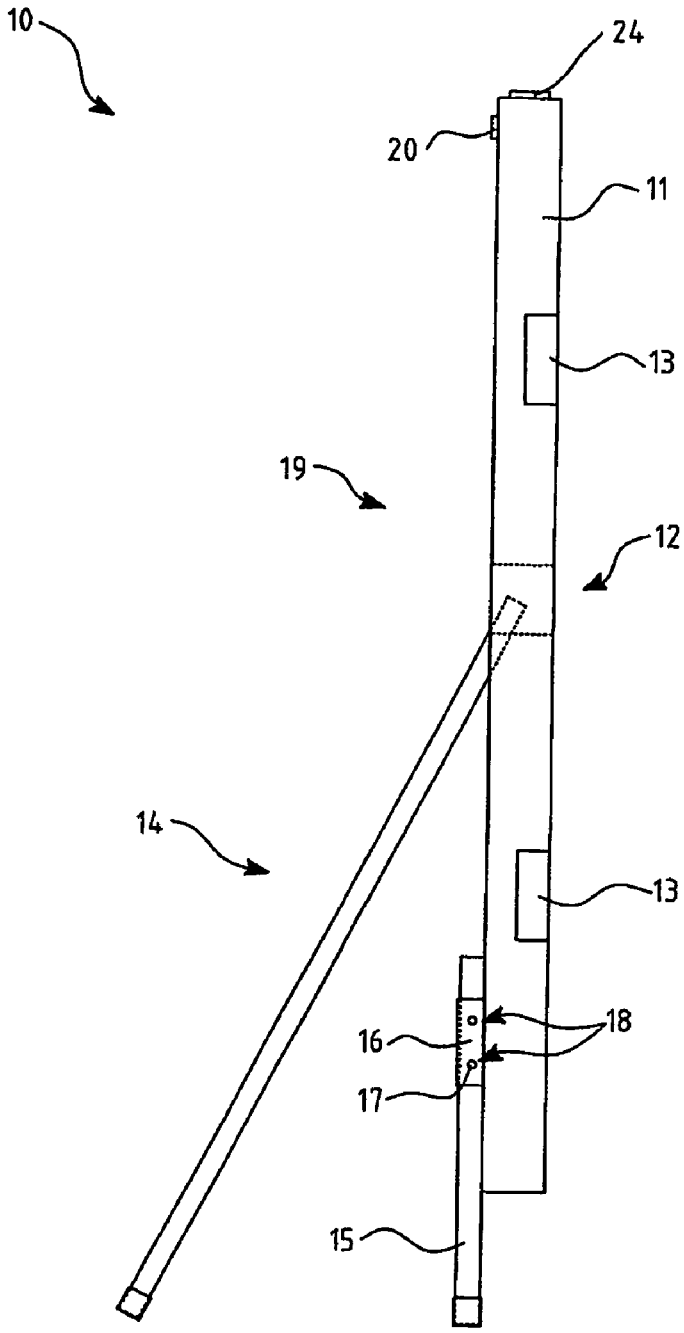
FIG. 4 is a side elevation of the charge carrier of FIG. 3.

A first preferred embodiment of a charge carrier (10) particularly adapted to the penetration of masonry walls, including single, double and cavity brick walls, concrete block walls and light formed concrete walls, is shown in FIGS. 3 and 4. A perimeter frame (11) is formed of polymeric hollow section and includes at least one cross member (12). Carrier perimeter frame (11) is further provided with carry handles (13) and a telescopically adjustable hinged support brace (14). Height adjustment of the frame may be provided by means of foot elements (15) sliding in sleeves (16) and located at a preferred height by locking pegs (17) passing through a plurality of holes (18) in sleeves (16).

Arranged at intervals on the rear face (19) of frame (11), that is that face directed away from the masonry wall to be penetrated, is a plurality of charging ports (20) to allow for detonation of the explosive charge elements carried by the frame.

One preferred sectional shape of a perimeter frame (11) and cross member (12) is shown in FIG. 5. The front face (21) of the extruded sections, that is the face directed towards the object to be penetrated, is shaped with a holding channel (22) adapted to receive as a snap-fit pre-formed elongate charge elements of either the flexible frangible cutting sheet or the flexible frangible explosive cutting sheet type as described above. The frame members may be extruded in a variety of cross sectional shapes and charge holding cavities to suit various operational conditions and charge element shapes.

Again with reference to FIGS. 3 and 4, frame (11) is sealed and is provided with filler ports (23) and closure caps (24) allowing the frame to be filled with a tamping agent such as water. Optionally, frame (11) may be prepared at manufacture with a gelling agent so as to create a gel when the frame is filled with water to prevent leakage in the case of accidental fracture of the frame in an operational situation.

The frame charge element holding cavity (22) is preferably so configured as to obviate the need for the charge element to be provided with stand-off material; the required stand-off distance being provided by the frame itself as shown for example in FIG. 6. Here an elongate shaped charge (25) comprising flexible frangible cutting sheet (26) and explosive agent (27) has been fitted to cavity (22).

Figure 7:
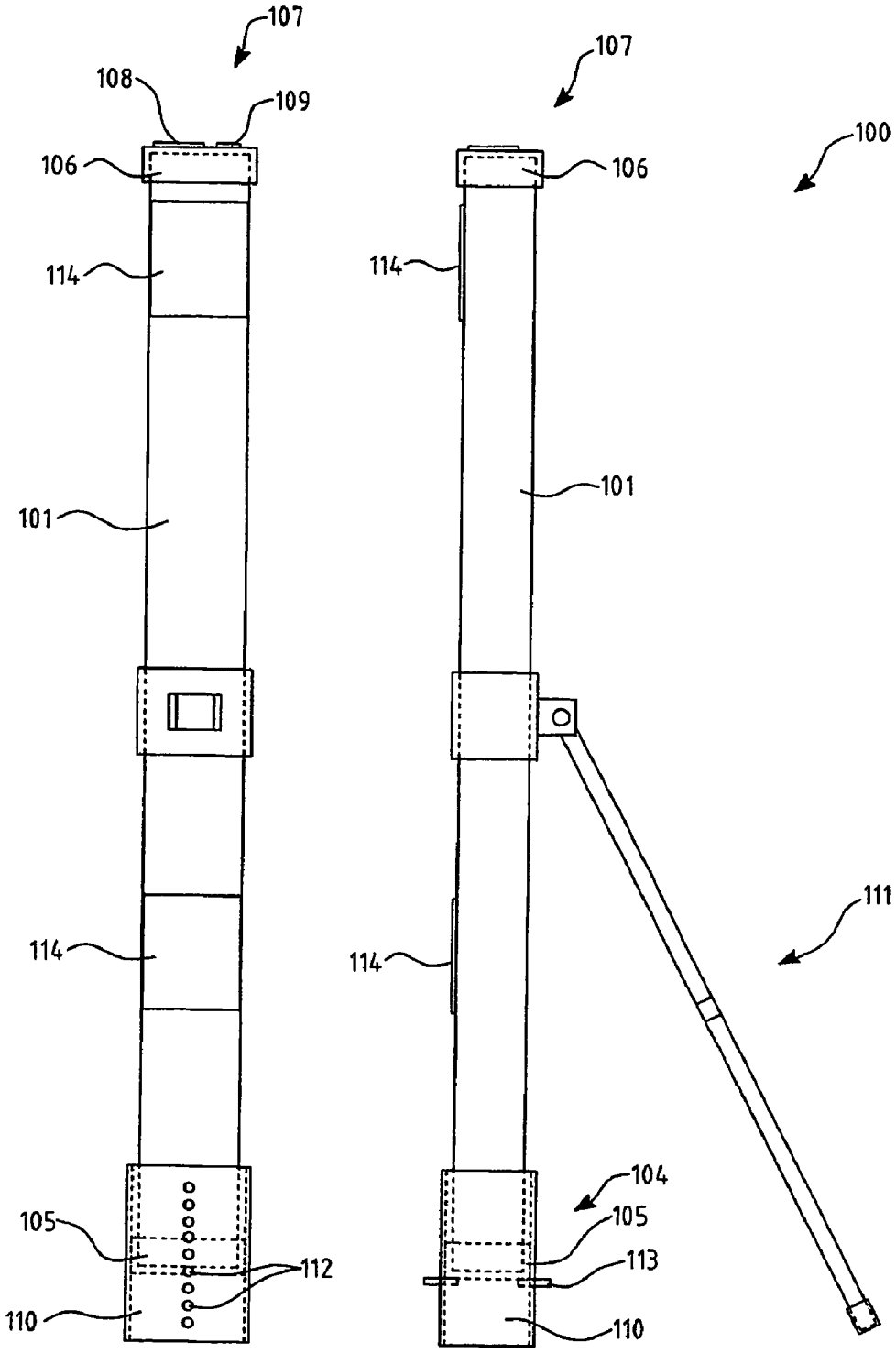
FIG. 7 is a rear elevation view and side view of a second charge carrier according to the invention.

In a second preferred embodiment of a charge carrier according to the invention as shown in FIG. 7, carrier 100 is adapted to effect a directed explosive charge in which water or other fluid acts as the penetrating agent. This second preferred embodiment is adapted in particular to any of a variety of door constructions, including commercial or domestic metal roller doors, metal doors, fire doors, reinforced timber doors and glass doors. It may also be used for some wall structures.

As shown in FIG. 7, charge carrier (100) has a main body (101) preferably formed of an extruded polymer section (as can best be seen in FIG. 8), although it may also be formed as a casting or fabrication. The composition of the polymeric barrier body (101) may include plasticisers to reduce brittleness. The carrier body (101) may be of any desired length depending on the intended application but is preferably in the range of 1.2 to 1.8 meters. Although a rectangular section is preferred, the body (101) may be square, triangular, oval or circular.

Figure 8:
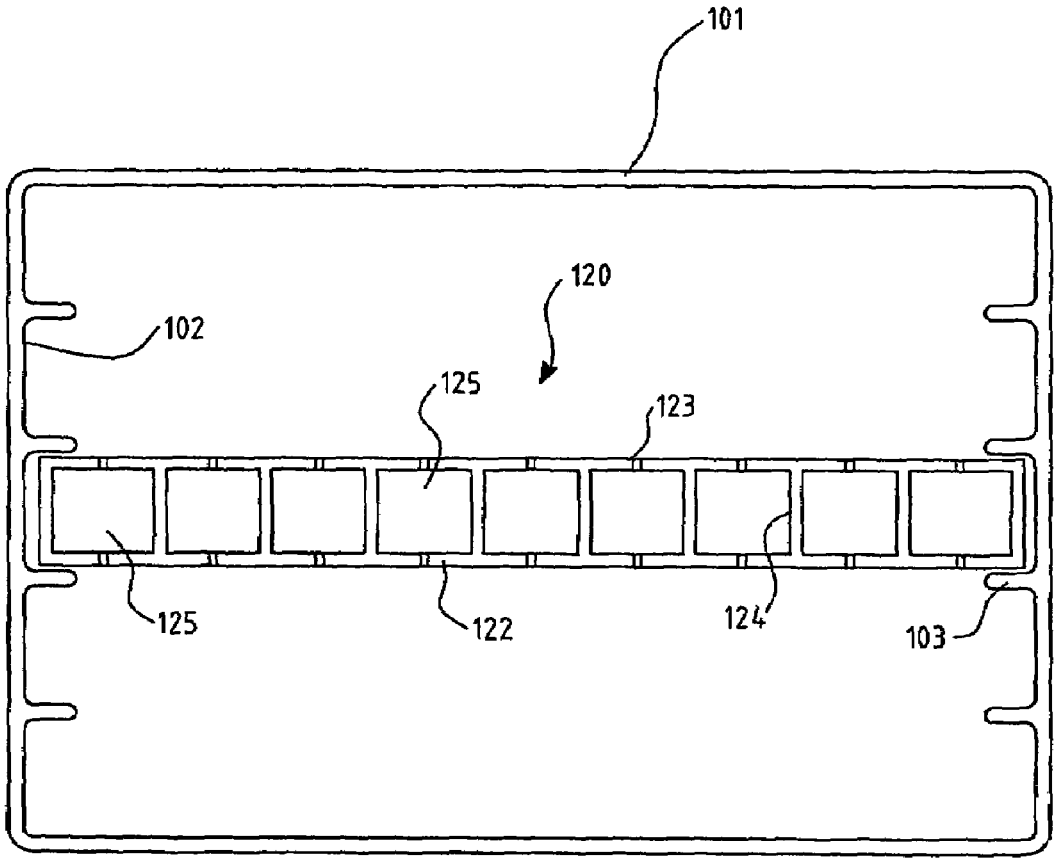
FIG. 8 is a cross sectional view of the charge carrier of FIG. 7.

As shown in FIG. 8, the internal side walls (102) of body (101) are provided with guide rail elements (103). Body (101) is sealed at a first end (104) with a sealing end cap (105) and provided with a filler end cap (106) for closure at a second end (107). Filler end cap (106) is further provided with a filling port closure cap (108) and a detonating cord grommet (109) as shown more clearly in FIG. 10.

Sealing end cap (105) may be permanently assembled to body (101) during manufacture, while filler end cap (105) remains detachable until the carrier is prepared for use at a detonation site. Alternatively, both end caps may be supplied loose so as to allow detonation access to both ends of the carrier body.

Carrier body (101) may further be provided with an adjustable foot portion (110) to allow for height adjustment and a telescopically adjustable hinged support brace (111). Adjustable foot portion (110) may be formed of a sleeve of larger section than the sealing end cap (105) and be provided with a plurality of adjustment holes (112) for the insertion of suitable locking pegs (113). Additionally, carrier body (101) may be fitted with flexible magnetic strips (114) so as to allow for its attachment to metal surfaces.

Figure 9:
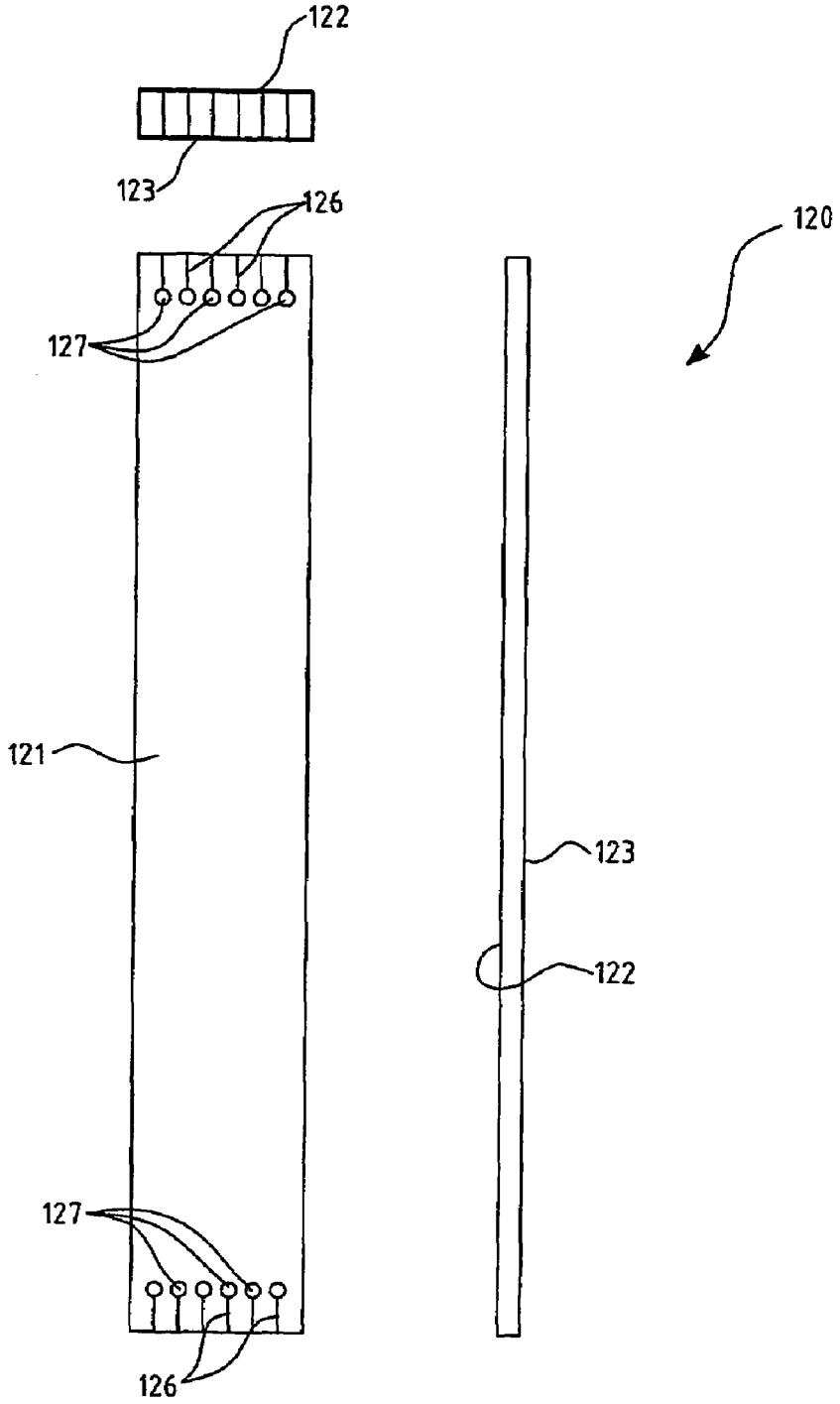
FIG. 9 is a front, side and end view of a loading card according to the invention.

Guide rail elements (103) are adapted to locate an explosive loading charge (120). In a first form as shown in. FIG. 9, the loading charge (120) is comprised of a loading card (121) and detonating cord (not shown) Preferably, loading card (121) is in the form of a rectangular sectioned extruded polymer slat having front and rear wall portions (122) and (123) with a plurality of transverse divider portions (124) so as to form a number of longitudinal passages (125) between the two wall portions, as shown in FIG. 8. The thickness of the card is such as to mate as a friction fit in rail elements (103). In one preferred form of the card (120) as shown in FIG. 9 the outer ends of the card are provided with slots (126) and holes (127) coinciding with passages (125).

In this form a desired length of detonating cord may be installed as lying along the face of the front wall portion (123) of the card, looping through the slots and holes so as to locate the cord to the card. Alternatively, the detonating cord may be threaded through the passages (125) and so winding about the front wall portion (122).

In use, a length of loading card is prepared with a length of detonating cord, lengths of both card and detonating cord selected according to the expected force required to achieve penetration, and inserted into the guide rail elements (103). The detonating cord is passed through the grommet (109) of the filler end cap 106 and the cap assembled to the carrier body (101), for example by the use of a suitable adhesive.

The carrier body can now be filled with a tamping fluid. Optionally, the carrier body (101) may be prepared with a lining of a suitable gelling agent so that when filled, the fluid forms into a gel thus preventing leakage of the tamping fluid in the event of accidental fracturing of the carrier body, or lternativley a gelling agent may be added with the water. When detonated, the charge on the loading card, explosively accelerates the tamping fluid through the carrier body and into the target other tamping agents than water may be used such as sand or soil. These agents can be readily introduced into the charge body through the large filling port.

The effectiveness of the penetrating operation of the second charge carrier embodiment may be enhanced by the placement of a flexible frangible cutting sheet In front of the detonating cords, or alternatively, replacing the detonating cord with a flexible frangible explosive cutting sheet. This sheet may be attached to the loading card by adhesive tape, for example or be adapted to slide into slide rails between the loading card and the target side of the charge carrier.

This second embodiment of a charge carrier according to the invention described above is particularly suited to the forced entry of doorways where there is a perceived asymmetry of strength in the door structure. Thus for example in a roller door situation, the charge is effective in urging that side of the door from its guide rail when the carrier body is aligned adjacent to an edge of the roller door.

An advantage of the present embodiment is that the flexibility of the system allows it to be prepared, if required, on-site to suit a wide range of forced entry requirements.

The carrier is designed so that the explosive charge can be tamped in a number of different ways. It can be located to act as an outright fracturing charge to take advantage of the brisance of the explosive detonation. Alternatively as indicated above, the charge can be sandwiched between layers of tamping material. In this configuration the tamping layer away from the target acts as a tamping agent, increasing the effectiveness of the explosive effect and minimizing overpressure effects. The side towards the target conveys explosive energy into the target material. Water, or gelled water is the optimum tamping material, offering excellent confinement with no shrapnel concerns.

The loading card can be pre-assembled with the explosive load. It then takes only moments to prepare the charge carrier. An advantage of the separate loading card is that only it needs be stored in an explosive magazine; the other components may be stored in any convenient way. Various loading cards of different lengths and with varying explosive loads may be pre-assembled and stored in anticipation of use.

Alternatively, in a third preferred embodiment of a charge carrier, the components to make up a charge carrier are provided in a disassembled kit form. The kit then includes at least one length or a selection of lengths of polymer extrusion, a matching length or lengths of loading card, a sealing end cap and a filler end cap, as well as sufficient length of detonating cord and gelling agent. The sealing end cap may be pre-assembled to the carrier body but an alternative form of the kit may be supplied with two loose filler end caps thus allowing two or more charge carriers to be linked together into one explosive charge assembly.

In addition the kit may be provided with a roll of double sided adhesive tape to allow the charge carrier body to be directly attached to a surface. Where adhesion is not possible because of the nature of the surface, a support structure may be included in the kit in the form of the adjustable foot portion and hinged support brace as described above.

Figure 10:
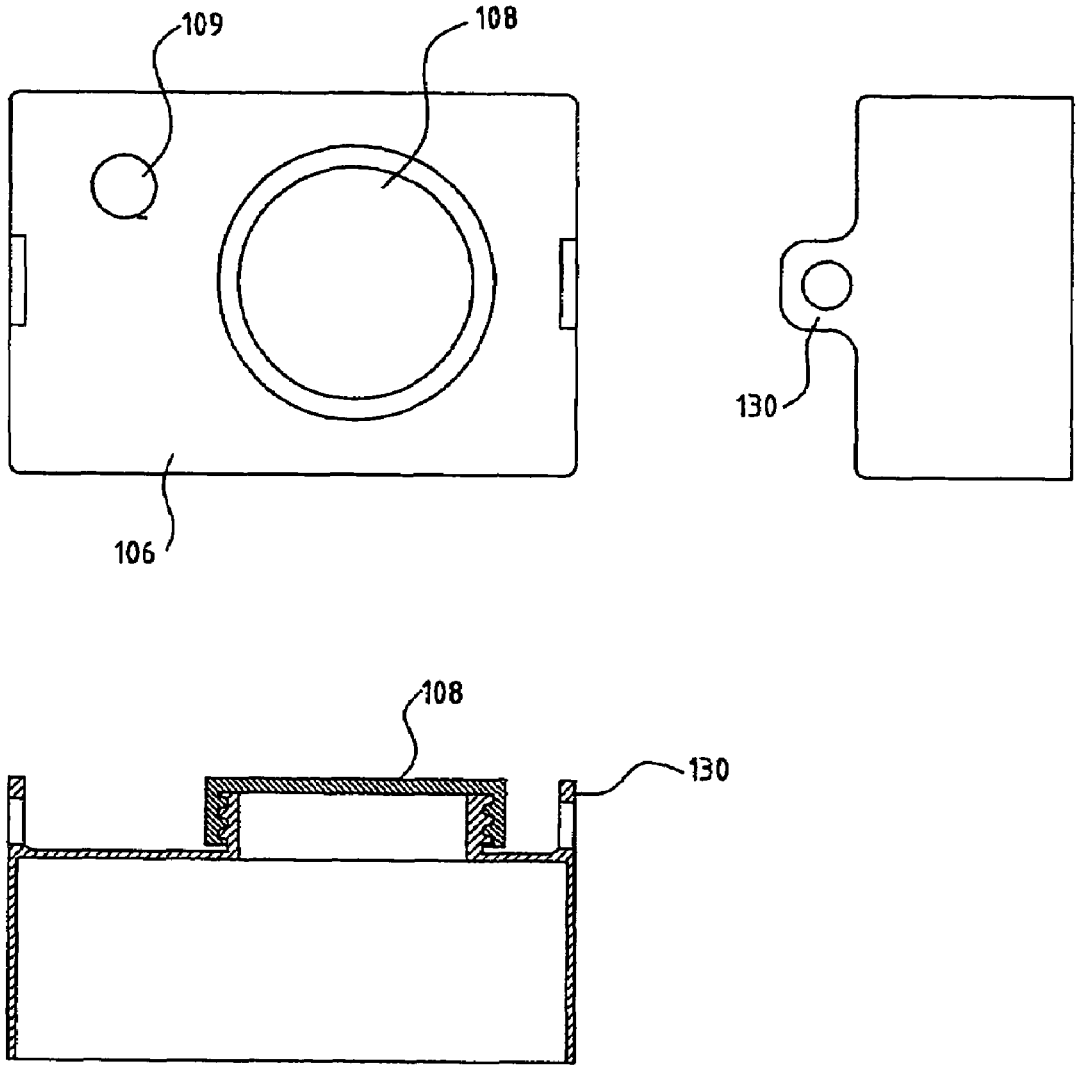
FIG. 10 is a detail elevation and plan view of a filling end cap of the charge carrier of FIG. 7.

In at least one preferred form of this embodiment sealing end cap and filler end cap may be provided with projecting lifting or attachment lugs 130 as shown in FIG. 10 for the attachment of carrying slings or as an aid to securing the charge carrier in a location for use.

Figure 11:
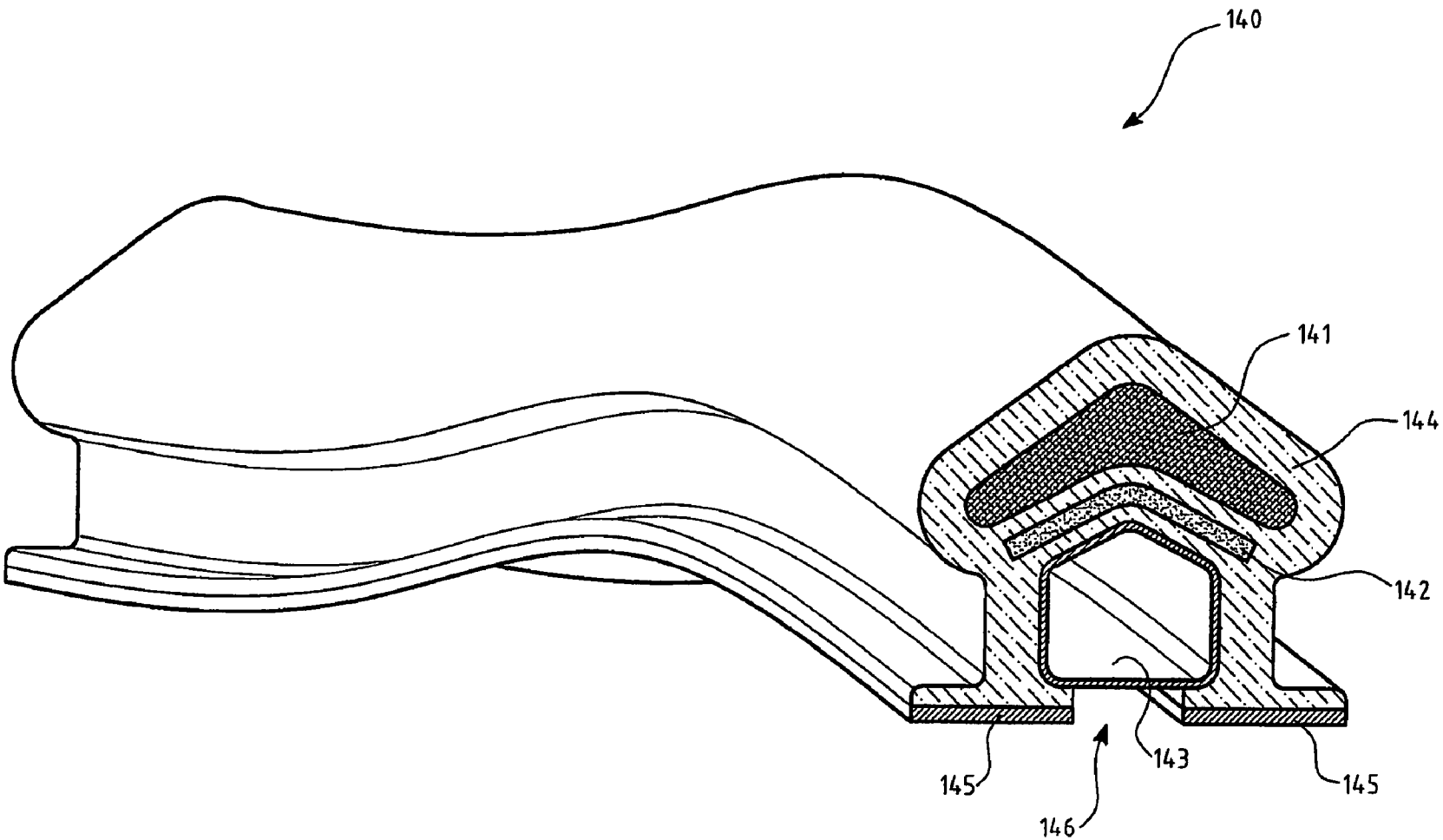
FIG. 11 is a sectioned perspective view of a linear charge system.

In yet a further embodiment of the invention as shown in FIG. 11, a linear charge system is provided in the form of a flexible elongate member 140 incorporating a malleable, in this example chevron shaped explosive 141, a liner 142 and a stand-off member 143, all held in the matrix of an inertial mass tamping carapace 144. The stand-off carcass may be in the form of a elongate flexible closed-cell foam structure or an extruded flexible hollow tubular member (as shown in FIG. 11).

In at least one preferred form of this embodiment the elongate member 140 may be provided with contact adhesive strips 145 along its underside or with flexible magnetic strips for retaining the elongate member against a surface to which the charge is to be applied.

As can be seen in FIG. 11 the inertial mass tamping carapace in cross section completely envelops the explosive 141 and liner 142 elements as well as the stand-off member 143 except for the gap 146 at its underside. This gap 146 is to allow the focussed passage of the high energy linear jet of gas and particles of the explosive.

The liner 142 is in the form of a separately extruded plastic matrix incorporating an extremely dense distribution of metal carbide as the main liner ingredient. This allows the generation of a high velocity, high density, extremely abrasive jet with superior penetrative performance.

The malleable explosive may be any readily available commercial sheet explosive with sufficient flexibility and an adequate detonation velocity. Exemplary products are Ensign Bickford Primasheet 2000, Dyno HLX sheet explosive, Royal Ordnance SX2 sheet explosive or Royal Ordnance Demex 200. All have adequate physical properties and velocity of detonation above 7600 metres/second, which is sufficient to enable efficient liner jetting.

The addition of a dense, non toxic, flexible, plasticized metal composite mass tamping carapace over the explosive chevron enables the detonation of the explosive to be effectively tamped at the detonation instant, thus focusing more detonation energy to effectively collapse and accelerate the liner into an effective penetrating jet. The mass tamping carapace may be composed of a dense inert compound, for example powdered barium sulphate or other dense non-toxic metal or metal compound and plasticizer on detonation the carapace disintegrates as a cloud of fine particles, with a very small lethal or injurious radius compared to totally metal enclosed linear shaped charges.

A tubular stand off member may optionally be pressurized for underwater use by the addition of elastomer bungs at the ends of the tube, one of which at least may be provided with one way valve means to introduce and retain a gas under the required pressure. This system has advantages over a comparable closed cell foam stand off which will gradually compress as the gas filled bubbles in the foam contract with increased water pressure, thus reducing the optimum stand off that a linear shaped charge needs for adequate cutting performance.

Since a gas filled pressurized tubular support is better able to withstand water pressure it enables the liner to jet with more effect into the target and without the jet degrading by passage through foam.

Although the present embodiment has made reference to a chevron shaped explosive charge, it will be clear to a person skilled in the art that any shape inducive of producing a "Monroe Effect", such as for example an arcuate sectional shape or an arrangement in a number of segments may also be effectively employed.

The present embodiment may be pre-assembled for "off-the-shelf" availability in a number of configurations to suit a variety of commonly encountered requirements. Alternatively, it may be provided in kit form. The kit may include one or a number of standard lengths of closed cell foam or open tubular stand-off carcass, and a quantity of pre-cut sheet explosive so as to enable a user to assemble a desired thickness on-site. The kit would also contain an appropriate length or lengths of liner of nominated properties and composition as well as one or more lengths of tamping carapace produced in a form allowing insertion of the explosive, liner and carcass components. Accessories, such as adhesive or magnetic strips, closing bungs and adhesives to fix them in place, and a hand pressurization pump for example, may also be provided.

Figure 12:
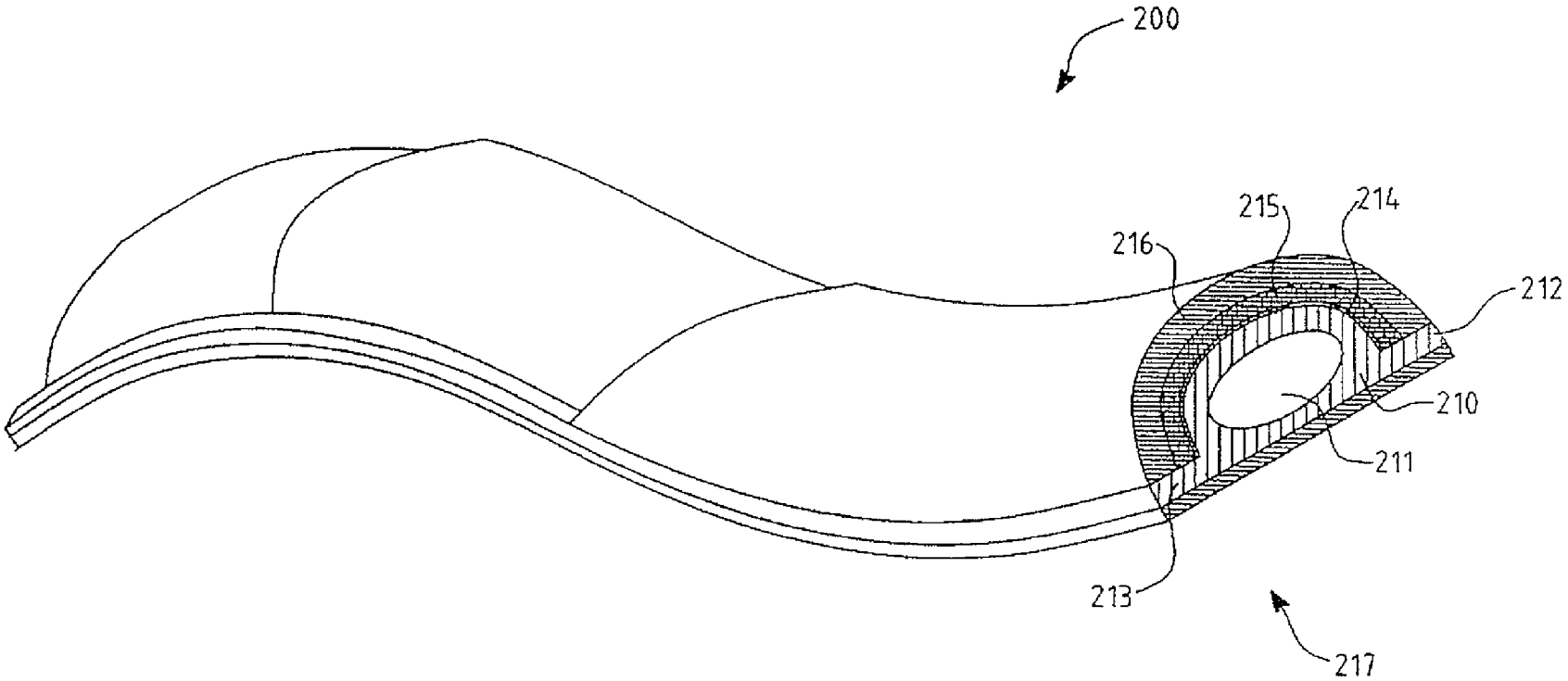
FIG. 12 is a diagramatic, not to scale, representation of a sectioned perspective view of a linear shaped charge element.

In yet a further preferred embodiment of the invention as shown in FIG. 12 a linear shaped charge element 200 is formed of an extruded carcass 210 of closed cell foam having a hollow tubular center 211. The carcass has side flange portions 212 and 213 which form termination elements for a first overlaid layer 214 of a composite liner material, a second overlaid layer 215 of explosive sheet and a third overlaid layer 216 of an inertial mass tamping carapace. Both layers are affixed to the carcass 210 by a suitable adhesive. Preferably, the liner material is formed of tungsten carbide particulates in a flexible plastic matrix.

The underside 217 of the linear shaped charge element may be provided with an adhesive layer 218 so as to allow the charge to be applied to any suitable surface. The flexible nature of this embodiment allows of its application to complex curved surfaces, such as for example to circular section pylons, steel tanks and even the surfaces of vessels for example.

Figure 13:
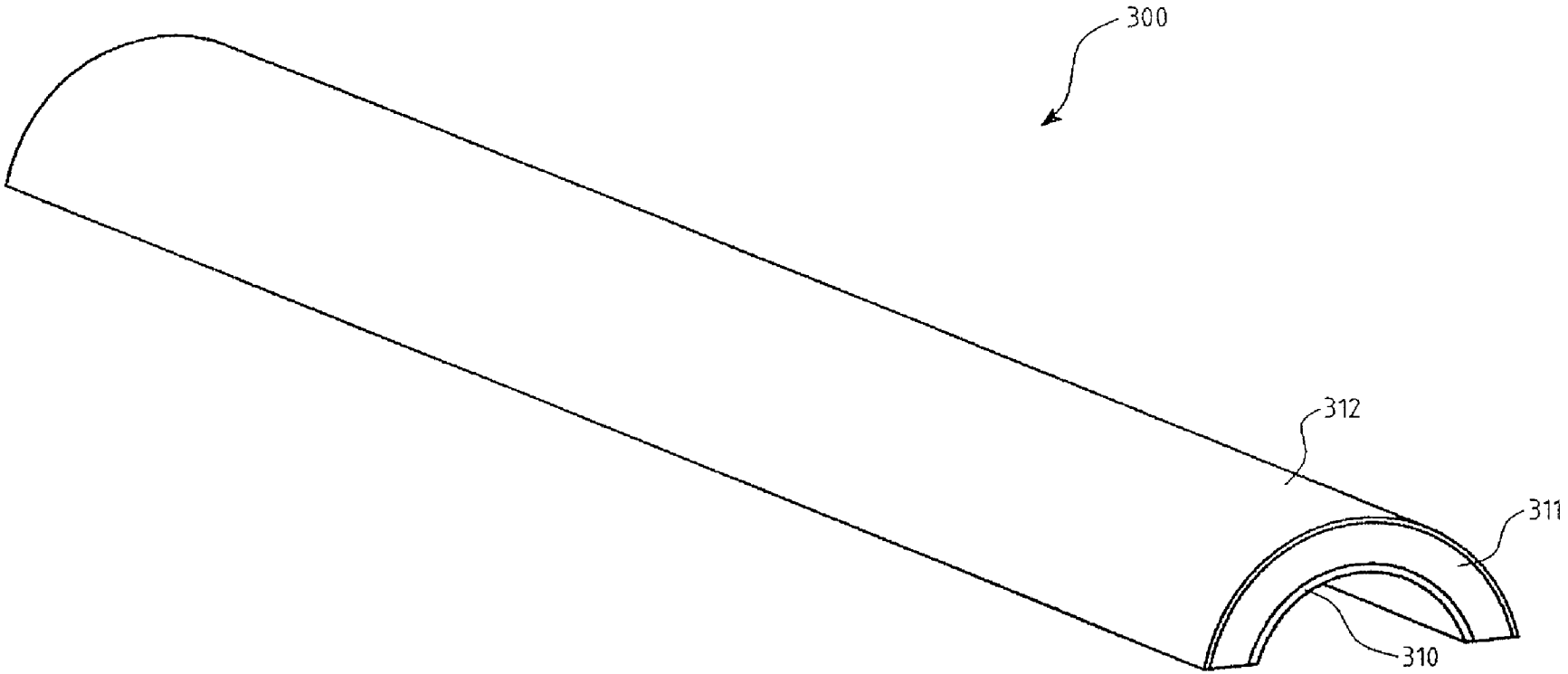
FIG. 13 is a diagramatic, not to scale, representation of a section of a further preferred linear charge element.

In a further preferred embodiment of a linear charge element 300 as shown in FIG. 13, a section of explosive sheet 311 is affixed to a plastic carrier 310 in the form of a portion of a plastic tube such as for example PVC pipe. In this embodiment the explosive charge covered by a layer of cardboard backing 312.

The above describes only some embodiments of the present invention and modifications, obvious to those skilled in the art, can be made thereto without departing from the scope and spirit of the invention.

The invention claimed is:

1. A flexible linear charge element adapted to the penetration of a structure; said linear charge element forming an elongate composite structure; said composite structure including: (a) an extruded carcass of closed cell foam; (b) a first overlaid layer of a cutting sheet liner component, said first overlaid portion overlaying and abutting said carcass; (c) a second overlaid layer of explosive sheet, said second overlaid layer overlaying and abutting said first overlaid layer; and (d) a third overlaid layer of an inertial mass tamping cararpace, said third overlaid portion overlaying and abutting said second overlaid portion, wherein said carcass is provided with side flange portions; said side flange portions providing termination elements for said first, second and third layers; each of said first, second and third layers being affixed to said carcass by a suitable adhesive such that each of said first, second and third layers abut said side flange portions; said inertial mass cararpace comrprising a dense, non-toxic, flexible plasticized metal composite.

2. The liner charge element of claim 1 wherein said cutting sheet liner component is disposed between said layer of explosive sheet and said extruded carcass.

3. The linear charge element of claim 2 wherein said cutting sheet liner component comprises a matrix of polymers incorporating a dense distribution of metal carbide particles.

4. The linear charge element of claim 1 wherein said layer of explosive sheet is a shaped charge component; a shape of said shaped charge component adapted to produce a "Monroe Effect" when detonated.

5. The linear charge element of claim 1 wherein said inertial mass tampering carapace is formed of a dense inert compound.

6. The linear charge element of claim 5 wherein said inert compound comprises powdered barium sulphate.

7. The linear charge element of claim 1 wherein said standoff member component is adapted to provide a separation between said cutting sheet liner and said structure.

8. The linear charge element of claim 7 wherein said extruded carcass is in the form of an elongate flexible closed cell foam structure.

9. The charge element of claim 7 wherein said extruded carcass is in the form of an elongate flexible hollow tubular member.

10. The linear charge element of claim 1 wherein said composite structure is provided with attachment means adapted to attach said linear charge element to a surface of said structure.

11. The charge element of claim 10 wherein said attachment means comprises at least one adhesive strip arranged along an underside of said composite structure.

12. The linear charge element of claim 11 wherein said attachment means comprises at least one magnetic strip arranged along an underside of said composite structure.

* * * * *